United States Patent [19]

Polarek

[11] Patent Number: 4,953,841

[45] Date of Patent: Sep. 4, 1990

[54] MACHINE AND PROCESS FOR SEPARATING SIGNATURES

[75] Inventor: Kenneth J. Polarek, Effingham, Ill.

[73] Assignee: World Color Press, Inc., Effingham, Ill.

[21] Appl. No.: 254,581

[22] Filed: Oct. 7, 1988

[51] Int. Cl.[5] ..... B65H 39/02

[52] U.S. Cl. ..... 270/58; 270/52; 209/552; 209/583; 209/939

[58] Field of Search ..... 270/52, 54, 55, 56, 270/57, 58; 209/552, 576, 939, 583

[56] References Cited

U.S. PATENT DOCUMENTS

| | | | |
|---|---|---|---|
| 4,167,476 | 9/1979 | Jackson | 270/58 |
| 4,388,994 | 6/1983 | Suda | 270/58 |
| 4,601,396 | 7/1986 | Pavie | 270/58 |
| 4,744,035 | 5/1988 | Hashim | 209/576 |
| 4,776,466 | 10/1988 | Yoshida | 209/576 |

FOREIGN PATENT DOCUMENTS

| | | | |
|---|---|---|---|
| 3205189 | 8/1983 | Fed. Rep. of Germany | 209/552 |
| 3520486 | 12/1986 | Fed. Rep. of Germany | 209/939 |

*Primary Examiner*—Edward K. Look
*Assistant Examiner*—Therese M. Newholm
*Attorney, Agent, or Firm*—Gravely, Lieder & Woodruff

[57] ABSTRACT

Mixed book signatures are fed into a machine which transports them one after the other past a camera where an image of each is captured. Each captured image is directed to an electronic computer which has stored within its memory images of limited areas of interest from selected signatures, as well as the location of each limited area within the overall signatures. As to each captured image, the computer compares the stored image with it, attempting to match each stored image with that location in the captured image corresponding to the location for the stored image. If the captured image identifies with a stored image, a controller activates a reject device along the conveyor, and that device diverts the identified signature from the conveyor. A separate reject device exists for each stored image, so like signatures are diverted and isolated at the same locations along the conveyor.

18 Claims, 2 Drawing Sheets

PROGRAMMABLE CONTROLLER
COMPUTER

A
S-1
S-2
X-1
Y-1
X-2
Y-2
K-1
K-2
W
b
S
t
P
2
20
22
24
30
32
34
36
50
56
66
68
70

MACHINE AND PROCESS FOR SEPARATING SIGNATURES

BACKGROUND OF THE INVENTION

This invention relates in general to the manufacture of books and, more particularly, to a machine for separating like signatures from a mixture of signatures.

The typical book, whether it be the traditional hard bound book, a paperback book or a perfect bound magazine, consists of a series of components, known as signatures, which are laid one upon the other in a small stack and are thereafter bound together and contained within a cover. The signatures, which are in effect booklets, represent the product of a printing press, and indeed usually several printing presses are dedicated to a particular book with each run of a press producing at least as many signatures as there are books scheduled for production. The press delivers these signatures in stacks and the stacks are stored until all of the different signatures required for the entire book are available.

When the full complement of signatures is available, the signatures are delivered to a binding machine which assembles them in the proper order—that is collates them—to produce a short stack which is eventually bound together. The collating and binding occurs in a perfect binding machine, which typically include a conveyor chain having so-called chain spaces and a succession of feeders over the chain. Each feeder holds like signatures, but the signatures of course differ from feeder to feeder. As the conveyor chain moves below the feeders, the feeders deposit signatures in the chain spaces that exist along it, thus building up within each chain space a short stack of signatures arranged in the proper order.

Sometimes a feeder will jam or otherwise fail to deliver a signature to a chain space, and as a result the stack which forms in that chain space is incomplete. A counting device on the binding machine detects the incomplete stack or book and rejects it before the signatures within it can be bound together.

While a press run normally produces signatures in excess of the number of books required, the excess often does not compensate for the number lost as incomplete books rejected by the perfect binding machine. As a result, the incomplete stacks so rejected are disassembled—or decollated—and the individual signatures so derived are again reintroduced into the appropriate feeders of the binding machine to be assembled into complete books.

Presently, printing companies decollate incomplete books with manual labor, but that is a time-consuming and expensive procedure, requiring individuals to visually inspect each signature of every incomplete book and place that signature on a stack of like signatures. The machine of the present invention automatically separates the signatures of the incomplete books, one from another, and with a camera captures an image of each. The machine includes a computer which compares each captured image with images stored in its memory, and if it identifies a captured image with one of the stored images, it directs the signature having the identified image to a station where like signatures possessing that image are collected.

DESCRIPTION OF THE DRAWINGS

In the accompanying drawings which form part of the specification and wherein like numerals and letters refer to like parts wherever they occur—

DETAILED DESCRIPTION

Figure 1:
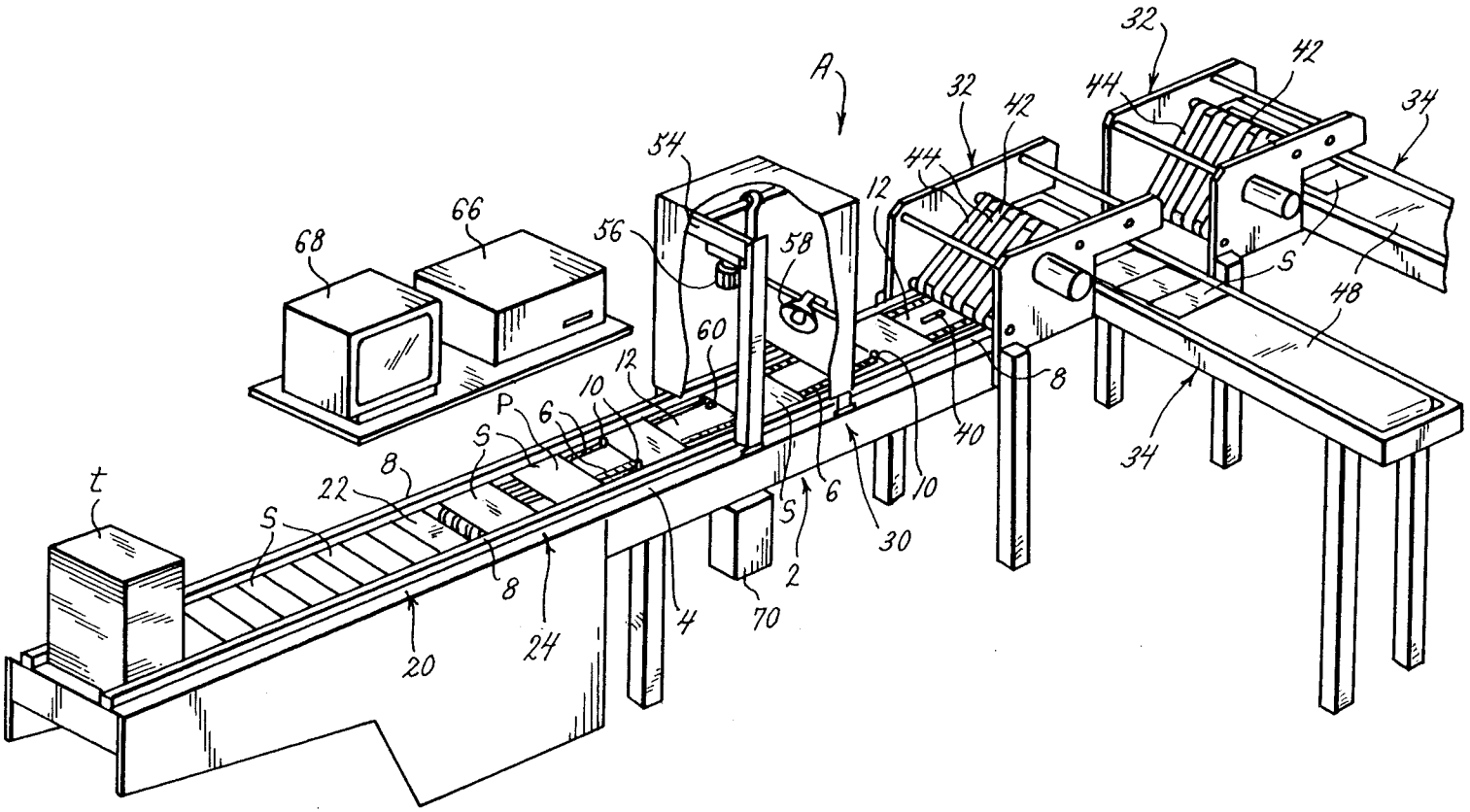
FIG. 1 is a partial perspective view of a decollating machine constructed in accordance with and embodying the present invention.

Referring now to the drawings, a machine A separates mixed and randomly arranged signatures S so that like signatures S are together. It is ideally suited for use in connection with a perfect binding machine, that is a machine having feeders arranged along a chain conveyor, with the feeders being capable of delivering signatures to chain spaces on the conveyor as the conveyor moves those chain spaces past the feeders. As a result, a stack of signatures, properly collated, builds up in each chain space as a book. Occasionally a feeder will jam or otherwise fail to deliver a signature to a chain space and when this occurs the book assembled in that chain space is incomplete. The binding machine includes a counting device for detecting and rejecting incomplete books. It is these books that the machine A separates into their individual signatures S so that like signatures S from many incomplete books accumulate together for reintroduction into the appropriate feeders of the binding machine.

The decollating machine A includes a conveyor 2 (FIG. 1) having a flat conveying table 4 and a pair of endless chains 6 which rise up toward the surface of the table 4 at the feed end of the conveyor 2 and descend at the opposite end of the conveyor 2, each thus forming an upper pass between the two ends of the conveyor 2. These upper passes are exposed through parallel slots in the table 4, and laterally beyond the slots, the table 4 is fitted with parallel guide rails 8. The space between the rails 8 constitutes a path P which is slightly wider than the signatures S are long. The chains 6 carry lugs or pins 10 which along their respective upper passes project through the slots in the table 4 to be presented above the upper surface of the table 4, that is to say, within the path P. Moreover, the pins 10 of the two chains 6 are synchronized such that they rise to the path P and move along the path P in pairs, with the pins 10 of any exposed pair being laterally aligned along the path P. The spacing between successive pairs of pins 10 exceeds the width of the signatures S. Thus, the pins 10 create so-called chain spaces 12 along the path P, with each chain space 12 being capable of accommodating a single signature S. Of course, the chain spaces 12 advance along the path P with the upper passes of the chains 6 and will thereby move a signature S from the feed end of the path P toward the opposite end.

The conveyor 2 derives the signatures S from a singulating feeder 20 which aligns with its feed end and deposits mixed signatures S one at a time into the chain spaces 12 as they develop at the feed end of the path P. The singulating feeder 20, which is conventional to the printing industry, accepts the different signatures S mixed randomly together in a stack t, but all in the same orientation, and includes an endless conveyor belt 22 which moves beneath the stack t and extracts the signatures S from the bottom of the stack t one at time. The extracted signatures S move away from the stack t in a somewhat shingled condition, but beyond the belt conveyor 22, the singulating feeder 20 has a transition section 24 which completely separates the shingled signatures S and further brings them up to a velocity corresponding to that of the chains 6 for the conveyor 2. The transition section 24 directs the separated signatures S onto the conveyor 2 at the feed end of its path P, where the signatures S drop into the chain spaces 12 to be conveyed along the path P as the chain spaces 12 move toward the opposite end of the table 4.

Figures 2, 3:
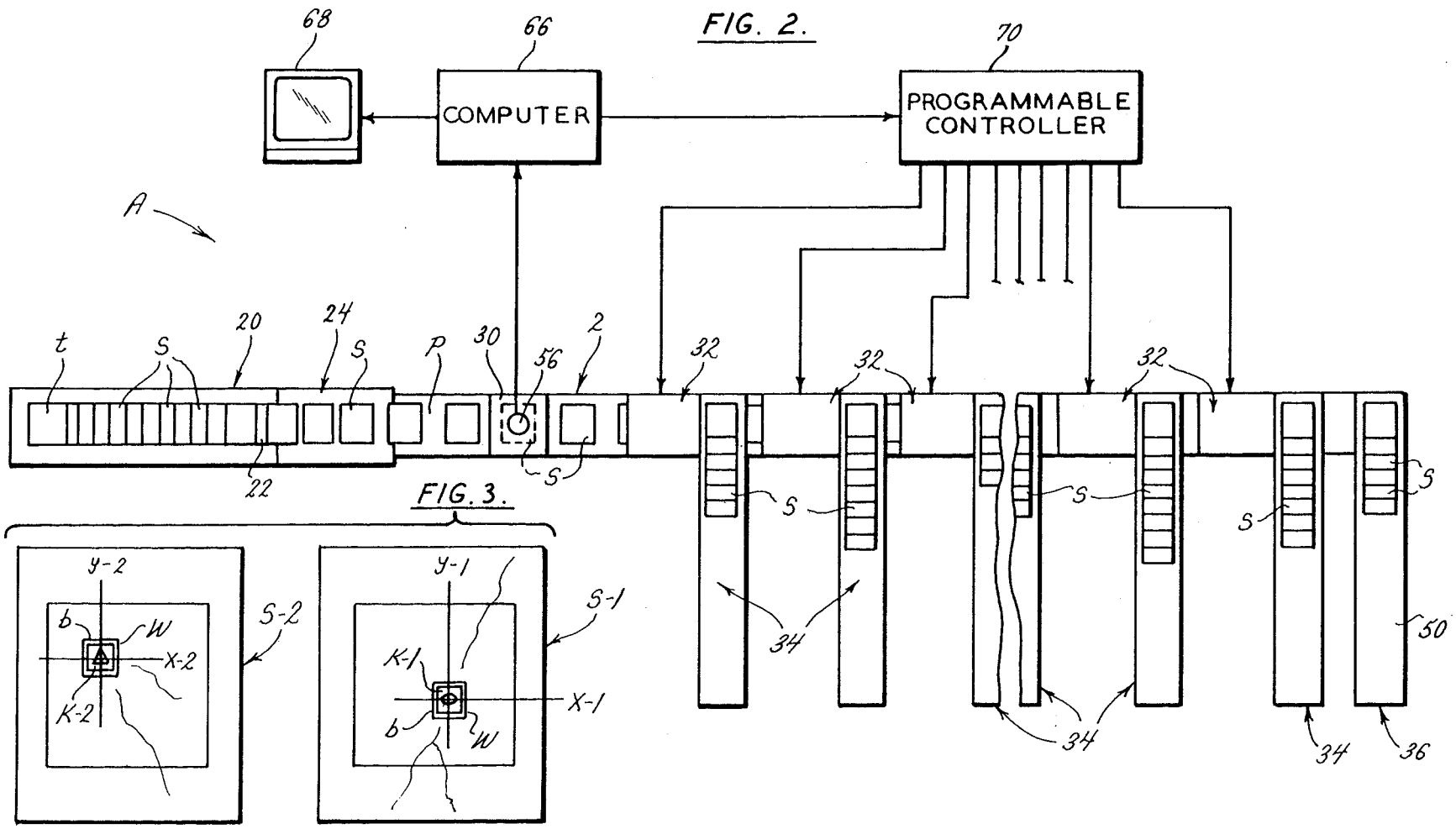
FIG. 2 is a block diagram schematically showing the machine of the present invention.
FIG. 3 depicts two successive signatures, each having outlined thereon the field of view observed by the camera, the area of interest stored in a memory of the computer, and a distinctive shape in the area of interest.

The initial portion of the path P remains essentially unobstructed, and here the conveyor 2 is provided with an inspection station 30 (FIG. 1) where signatures that advance along the path P are inspected and perhaps identified. Beyond the inspection station 30 lie a succession of rejectors 32 and storage conveyors 34, there being a separate storage conveyor 34 for each rejector 32 which form diverting means for diverting signatures from the path P. Beyond the last rejector 32 and its storage conveyor 34—indeed at the opposite end of the path P—is an accumulating conveyor 36 (FIG. 2).

The rejectors 32 are all essentially the same, differing only in location along the main conveyor 2. Each includes a deflector 40 (FIG. 1) which on command rises out of the table 4 to project into the path P and divert an approaching signature S upwardly. The deflector 40 may be operated by a solenoid or an air cylinder. Each rejector 32 also includes an elevating conveyor 42 which is attached to the table 4 and has upper and lower sets of belts 44 which come together at a nip located immediately above the table 4 and slightly beyond the deflector 40. The belts 44 extend upwardly from the nip and indeed have opposing passes which move away from the nip so that any signature S which enters the nip will be carried upwardly between the two sets of belts 44 and in effect removed from the path P along the main conveyor 2. Indeed, just that occurs when the deflector 40 of the rejector 32 is energized, for it rises out of the table 4 and directs the oncoming signature S upwardly into the nip formed by the belt 44 of the elevating conveyor 42.

The storage conveyors 34 (FIG. 1) likewise differ only in location, with each extending away from a different rejector 32 transversely with respect to the main conveyor 2. Each storage conveyor 36 includes an endless belt 48 which is slightly wider than the signatures S, and this belt at its feed end lies over the table 4 of the main conveyor 2 near the upper ends of the belts 44 for the elevating conveyor 42 of the rejector 32. The arrangement is such that the elevating conveyor 42 deposits signatures S that are directed into it onto the belt 48 of the storage conveyor 34. The belt 48 of the storage conveyor 34 moves only when the deflector 40 directs a signature S into the elevating conveyor 42, and then only a distance which is less than the length of the signature S. As a consequence, the deflected signatures S accumulate on the belt 48 of the storage conveyor 34 in a shingled condition.

The accumulating conveyor 36 (FIG. 2) likewise includes an endless belt 50 which is slightly wider than the signatures S, but this belt lies below the surface of the table 4 immediately beyond the discharge end of the path P. The arrangement is such that the chains 6 of the main conveyor 2 will propel any signature S which passes through all of the rejectors 32, without being deflected, off the end of the main conveyor 2 and onto the belt 50 of the accumulating conveyor 36. Like the belts 48 of the storage conveyor 36, the belt 50 of the accumulating conveyor 36 operates incrementally, moving a distance less than the length of the signatures S each time signature S is delivered to it. As a result, the signatures S assume a shingled condition on the accumulating conveyor 36.

Turning now to the inspection station 30, here the conveyor 2 is fitted with a frame 54 (FIG. 1) which projects upwardly from the table 4 and is located directly over the path P between the two guide rails 8. The frame 54 supports a camera 56, which is positioned such that its optical axis is perpendicular to the table 4 and bisects the path P, but the field of view for the camera 56 is narrower than the space between the guide rails 8. Actually, the field of view or scene V (FIG. 3) observed by the camera 56 is square, measuring, for example, about 7×7 inches at the table 4. The camera 56 produces an electronic video signal, such as that derived from a typical television camera. In addition to the camera 56, the frame 54 supports a strobe light 58 which is directed toward the table 4, indeed toward the location where the optical axis of the camera 56 intersects the path P. The strobe light 58 is under the control of a photodetector 60 located in the table 4 along the path P, so that the signatures S advanced by the conveyor 2 move over the photodetector 60. Each time the trailing edge of a signature S passes beyond the detector 60 to thereby expose the detector 60 to light, the detector 60 produces a signal which triggers the strobe light 58, causing it to produce a burst of light which illuminates the signature S. Indeed, the location of the photodetector 60 is such that the optical axis of the camera 56 is generally centered with respect to the signature S when the signature S triggers the strobe light 58. The image captured by the camera 56 is square in area and generally centered with respect to the signature S, and of course represents the scene V.

In addition to the foregoing components, the decollating machine A includes an electronic computer 66 to which the camera 56 is connected. The computer 66 has the capacity to digitize video signals derived from the camera 56. Each time the strobe light 58 flashes, the computer 66 receives a different video signal from the camera 56, a signal which it converts to a digital format. The computer 66 also contains a memory where it stores digitized images—indeed enough images to equal the number of rejectors 32 along the conveyor 2. Actually the image stored in the memory does not correspond to the full scene V observed by the camera 56, but instead represents only a small area of interest K (FIG. 3) within that scene V. In addition, the memory stores the location of that small area K within the overall scene V, for example, as coordinates in a cartesian coordinate system. The area of interest K may measure 25 pixels by 25 pixels.

The computer 66 also possesses the capacity to search an image captured by the camera 56, which is also a scene V, to determine if that captured image or scene V contains any of the several areas of interest K for the stored images—of course at the specific locations assigned to such areas. The search proceeds sequentially, with the computer 66 initially bringing up the area of interest K for the first stored image and comparing that area with an area of equivalent size and location in the captured image or scene V derived from the camera 56.

Inasmuch as the comparison is between areas, it is a two dimensional comparison. If correspondence exists, then the captured image or scene V identifies with the first stored image and no further searching is required. On the other hand, if no correspondence exists, the search proceeds on to the second stored image, which is the area of interest K for the next signature S, and this image is compared with the captured image or scene V in a like manner.

While as to any one of the stored areas of interest K, the search proceeds at that location in the captured scene V which corresponds to the location assigned to that area of interest K, some latitude does exist. To this end the computer 66 not only looks within the captured scene V for the stored area of interest K at the precise location assigned to it, but also in a somewhat larger area—an area enlarged by a boundary b (FIG. 3) that extends around the assigned area. If the computer 66 can establish a correspondence between the stored area of interest K and an equivalent area within the corresponding location enlarged by the boundary b, then identity between the stored area K and captured scene V exists.

The stored images, that is the stored areas of interest K, are derived from the camera 56 itself and require a monitor 68, which is connected to the computer 66 and includes conventional cathode ray tube, to effectively introduce the area of interest K into the memory of the computer 66, but only when the machine A and particularly its computer 66 are in their so-called "make ready" mode of operation. To this end a signature S which is selected for isolation and separation in the machine A, is advanced slowly along the path P by the chains 6, and as it passes under the camera 56 its presence is detected by the photodetector 60 which triggers the strobe light 58. In the burst of light so produced, the camera 56 delivers a video signal which appears on the monitor 68. The image represents the field of view observed by the camera 56 which is of course the scene V from the signature S. The image produced on the monitor 68 also includes a cursor in the form of a window W (FIG. 3) which can be moved about by manipulation of controls attached to the computer 66. The area contained within the window equals the size of the area of interest K which is to be stored in the memory of the computer 66. Manipulating the controls brings the window W to a highly unique portion of the scene V. By actuation of more controls, the area contained within the window W is introduced into the memory of the computer 66 as the area of interest K for the selected signature S, and so is the location of that area within the overall scene or field of view. The signature S so observed is further assigned to one of the rejectors 32. Areas of interest K for the remaining selected signatures S are introduced into the memory of the computer 66 in a like manner, and those signatures are likewise assigned to different rejectors 32.

A computer capable of performing the functions required of the computer 66 is sold by Cognex Corporation of Needham, Mass., which markets that computer under the designation COGNEX 2000.

The computer 66 is connected to a programmable controller 70 which in turn is connected to and controls the deflectors 40 for the several rejectors 32. It further tracks the endless chain 6, and thereby monitors the positions of the chain spaces 12 along the path P over the table 4. The signals derived from the computer 66 identify the signatures S with particular signatures S retained in the memory of the computer 66, and for each signal so received, the controller 70 energizes the deflector 40 for rejector 32 to which that signature S is assigned, but only after tracking the signature S to that rejector 32. Thus, while the computer 66 identifies signatures S as corresponding to selected signatures S stored in its memory, the controller 70 in effect directs the signatures S so identified to assigned storage conveyors 34, so only like signatures S accumulate on a particular storage conveyor 34. When the computer 66 cannot establish any identity between a signature S under the camera 56 and one of the stored images, the programmable controller 70 does not activate any of the deflectors 40, and as a consequence the unidentified signature S passes the entire length of the path P and is eventually deposited on the accumulating conveyor 36.

OPERATION

From the signatures S which are compiled to produce a book, as many different signatures S are selected as there are rejectors 32 and storage conveyors 36 located along the main conveyor 2. With the machine A in its make ready mode, these selected signatures S are dropped individually into chain spaces 12 ahead of the camera 56 and are slowly jogged beneath the camera 56. As a selected signature S moves beneath the camera 56, its trailing edge will move over the photodetector 60 and trigger the strobe light 58. The burst of light so produced illuminates the signature S with enough intensity to produce a video signal which passes through the computer 66 and appears on the monitor 68 as an image of the scene V observed by the camera 56, which is of course the central portion of the signature S. The operator now selects the most unique portion of the scene V and centers the window W over that portion. Thereupon the operator instructs the computer 66 to save that portion as the area of interest K for the signature S so selected. In so doing, the computer 66 reduces the area of interest K to a digitized format and further identifies it, in terms of Cartesian coordinates, with a specific location in the overall scene V or field of view. At this time the operator also assigns one of the rejectors 32 and its corresponding storage conveyor 34 to the signatures S.

The remaining selected signatures S are entered into the memory of the computer 66 and assigned rejectors 32 in a like manner. Thus, at the completion of the make ready mode, all of the selected signatures S are entered into the computer 66 in the sense that the computer memory holds a digitized format of an area of interest K for each and the location of that area of interest K within the overall scene V.

For example, the first selected signature S-1 (FIG. 3) may produce a scene V-1 containing an ellipse, which as to shape and location distinguishes the selected signature S-1 from the other signatures S in the book. By reason of this fact, the area of interest K-1 for the signature S-1 is selected such that it includes the ellipse. Thus the window W which appears on the monitor 68 is maneuvered about until it contains the ellipse, preferably at its center which is located at coordinates X-1, Y-1. With the window W so positioned, the area of interest K-1 contained within its boundary are entered into the memory of the computer 66 along with the coordinates X-1, Y-1. On the other hand, the second selected signature S-2 may be distinguished by a triangle located at coordinates X-2, Y-2. Once the area of interest K-1 for the first signature S-1 is entered, a scene V-2 derived from the second signature S-2 is brought up on the monitor 68 and the window W is maneuvered to the triangle. The area of interest K-2 located within the window W is entered into the memory of the computer 68, along with the coordinates X-2, Y-2. Areas of interest K from the remaining selected signatures S are entered in a like manner.

Once the selected signatures S have been entered into the computer 66, the machine A is ready to operate in its "separation mode" where it separates mixed signatures S so that like signatures S come together on the storage conveyors 34 with each storage conveyor 34 holding only the like signatures S assigned to it. The like signatures S may of course be retrieved from the storage conveyors 34. The mixed signatures S are arranged in stacks t, with the signature S within each stack t being oriented the same, that is, with their first page presented upwardly and their folds along one side of the stack t. The stack t is then placed into the sigulating feeder 20 with the signatures S of the stack t being in the same orientation as were the selected signatures S when they were advanced through the inspection station 30 during the make ready mode.

The sigulating feeder 20 withdraws the signatures S from the bottom of the stack t, one at a time, and advances them in a shingled condition to its transition section 24, whereupon the signatures S experience enough of an increase in velocity to totally separate them. Indeed, the transition section 24 brings the velocity of the signatures S to that of the endless chains 6 for the main conveyor 2 and discharges them one at a time into the feed end of the path P for the main conveyor 2 where they enter the chain spaces 12.

A different signature S drops into each chain space 12 and within each chain space 12, the signature S settles back against the pins 10 at the trailing end of the chain space 12. The guide rails 8, on the other hand, confine the signatures S laterally, and while the spacing between the rails 8 is slightly greater than the width of the signatures S, the clearance is relatively small, so little free motion exists laterally. The chains 6 of the main conveyor 2 advance the mixed signatures S in succession along the path P through the inspection station 30 where they pass beneath the camera 56 and over the photodetector 60.

As the trailing edge of a signature S passes beyond and exposes the photodetector 60, that device triggers the strobe light 58 which produces a burst of light that illuminates that signature S. The camera 56 observes the illuminated signature S, or more accurately that portion of the illuminated signature S that is within its field of view, and produces a video signal which passes on to the computer 66 and the monitor 68, appearing on the latter as an image of that much of the signature 3 that lies within the field of view. The image of course is the scene V observed by the camera 56. The computer 66, on the other hand, digitizes the video signal, thus reducing the scene V observed by the camera 56 to a digitized format. The computer 66 further compares the digitized scene V with the digitized areas of interest K stored in its memory, and that comparison not only takes into consideration the digitized content of each area of interest K, but location of the area of interest K in the overall scene V as well. Indeed, the comparison proceeds from one area of interest K to the next until the computer 66 recognizes a correspondence between the stored area of interest K and the digitized scene V derived from the signature S immediately beneath the camera 56.

Continuing with the example, the computer 66 searches the captured scene V, looking first at coordinates X-1, Y-1 (FIG. 3) to see it possesses a configuration corresponding to the first stored area of interest K-1, and to achieve correspondence an ellipse must of course appear at coordinates X-1, Y-1. If no correspondence exists, the computer 66 looks to the second stored area of interest K-2 and that portion of the captured scene V located at coordinates X-2, Y-2 and here correspondence requires a triangle in the captured scene.

Once this recognition is made the computer 66 directs a signal to the programmable controller 70, identifying the signature S as one to which the one of the rejectors 32 and storage conveyors 34 have been assigned. The programmable controller 70 thereupon tracks the identical signature S as it advances beyond the inspection station 30 on the main conveyor 2, and when it reaches the rejector 32 assigned to that area of interest K with which the signature S identifies, the controller 70 energizes the deflector 40.

The chains 6 of the main conveyor 2 push the identified signature S over the deflector 40 and into the nip formed by the belts 44 of the elevating conveyor 42. The belts 44 of the rejector 32 in turn deliver the identified signature S to the storage conveyor 34 for that rejector 32 where it forms part of an accumulation of like signatures S deposited in a similar manner. Indeed, each time the elevating conveyor 42 for the rejector 32 delivers a signature S to the storage conveyor 34, the belt 48 of that conveyor indexes a distance less than the length of the signature S, so that like signatures S accumulate on the belt 48 in a shingled condition.

Any signatures S which the computer 66 does not identify with any of the stored areas of interest K pass the full length of the path P and drop onto the belt 50 of the accumulating conveyor 36 at the end of the table 4.

Where the number of signatures S scheduled for separation exceeds the number of rejectors 32 in the machine A, the machine A may still be employed to completely separate the signatures S. To do so the operator merely runs the signatures S through the machine in two or more passes. Those signatures which identify with stored areas of interest K on the first pass are of course isolated and deposited on the storage conveyors 32. The remaining signatures S proceed through to the accumulating conveyor 36. Then the machine A undergoes another make ready mode where areas of interest K for selected signatures S on the accumulating conveyor 36 are stored in the memory of its computer 66. Now, when the machine A is again operated in its separation mode, it isolates these signatures S. Enough passes are run to separate all the signatures S.

This invention is intended to cover all changes and modifications of the example of the invention herein chosen for purposes of the disclosure which do not constitute departures from the spirit and scope of the invention.

What is claimed is:

1. An apparatus for separating like book signatures from a mixture of book signatures, said apparatus comprising: means for moving the signatures one after the other along a path in a predetermined orientation in the path; a camera located along the path such that the signatures as they are advanced by the conveying means come successively within the field of view for the camera; diverting means located along the path for directing signatures to selected locations upon command, with each location being separate from the other locations and being reserved for like signatures; and computing means connected with the camera and to the diverting means for a. storing within a memory an image of a limited area of interest from each of several signatures that are to be separated into groups of like signatures and the locations of those limited areas within the signatures, b. through the camera capturing images from signatures that come within the field of view for the camera, c. comparing the stored images one after the other with each successive captures image, with each comparison being between the limited area of interest for the stored image and an area of similar location in the captured image so as to identify those captured images which correspond with stored images both as to content and location, with the comparison being two dimensional in character, and d. as to each identified captured image, commanding the diverting means to direct the signature having that image to the location reserved for signatures having that image, whereby like signatures are isolated at separate locations.

2. An apparatus according to claim 1 wherein the diverting means includes a plurality of reject means located in succession along the path, each for diverting upon command from the computing means a signature to a different location along the path.

3. An apparatus according to claim 2 and further comprising storage means at each reject means for receiving the signatures diverted from the conveying means by the reject means, whereby like signatures accumulate on each storage means.

4. An apparatus according to claim 3 wherein each storage means includes a conveyor which receives signatures from the reject means at which it is located and moves those signatures away from the reject means.

5. An apparatus according to claim 2 and further comprising accumulating means located along the path beyond the several reject means for receiving those signatures which are not diverted by any of the reject means, whereby the accumulating means receives those signatures which differ from the selected signatures which produce images that correspond to the stored images.

6. An apparatus according to claim 5 wherein the accumulating means includes a conveyor which is located at the end of the conveying means where it receives signatures and moves them away from the converging means.

7. An apparatus according to claim 1 and further comprising illuminating means for producing a burst of light that illuminates a signature within the field of view of the camera, and sensing means located along the path for detecting the presence of a signature within the field of view and for causing the illuminating means to produce a burst of light to illuminate that signature.

8. An apparatus according to claim 1 and further comprising feed means for withdrawing the mixed signatures one at a time from a stack of such signatures and delivering them one at a time to the conveying means so that they are advanced along the path in succession by the conveying means.

9. An apparatus according to claim 2 wherein the computing means upon identifying the image produced by a signature with a stored image from a selected signature, tracks that signature which produced the image along the path until it reaches the reject means assigned to the selected signature with which the identification is made, whereupon it commands the reject means to divert the signature from the conveying means.

10. An apparatus according to claim 1 wherein the stored and captured images represent areas substantially less than the field of view for the camera.

11. A process for separating like book signatures from a mixture of book signatures, said process comprising: storing within an electronic computer images of limited areas from selected signatures as well as the locations of those limited areas in their respective signatures; capturing images of individual signatures from the mixture of signatures, one after the other; with the computer comparing in two dimensions each captures image with stored images, with the comparisons being between the limited areas of the stored images and locations in the captured images which correspond to such limited areas in the stored images; with the computer, identifying a captured image that corresponds to a stored image as to content of a limited area in the captured image and the location of that limited area; and directing each signature that produces a captured image which corresponds to a stored image to a location reserved for signatures which likewise identify with the stored image, whereby like signatures are directed to locations reserved for such signatures.

12. The process according to claim 11 and further comprising moving the mixture of signatures one after the other along a path; and wherein the images of the signatures are captured at a specific location along the path.

13. The process according to claim 12 wherein the image of each signature is captured by subjecting the signature to a burst of light at the specific location and observing the signature with a camera while it is illuminated with the burst of light at the specific location.

14. The process according to claim 12 wherein the specific areas to which identified signatures are directed are located successively along the path.

15. The process according to claim 11 wherein the step of capturing images of selected signatures includes observing the selected signatures with a camera, with the selected signatures coming one after the other into the field of view for the camera.

16. The process according to claim 15 wherein the step of storing images of selected signatures within the computer includes bringing the selected signatures into the field of view for the camera and entering the images into the computer through the camera.

17. An apparatus for separating like book signatures from a mixture of book signatures, said apparatus comprising: conveying means for moving the signatures one after the other along a path in a predetermined orientation in the path; a camera located along the path such that the signatures as they are advanced by the conveying means come successively within the field of view for the camera; diverting means located along the path for diverting signatures from the path to selected locations upon command, with each location being separate from the other locations and being reserved for like signatures, and computing means connected with the camera and to the diverting means for a. storing within a memory a selected image from each signature which is to be separated and the location of that image within a larger scene from the signature, b. through the camera capturing images from signatures that come within the field of view of the camera with the images so captured being larger than any one of the stored images, c. comparing the stored images with the captured images at the locations in the captured images corresponding to the locations of the stored images, d. identifying those captured images which correspond both as to content and location with any one of the stored images, and e. as to each identified captured image, commanding the diverting means to direct the signature having that image and location to the selected location reserved for signatures having the image at the location for that image;

whereby like signatures are isolated at the separate locations.

18. An apparatus according to claim 17 wherein the diverting means includes a plurality of reject means located along the path, each for diverting upon command from the computing means a signature to a different location along the path.

* * * * *